US009568859B2

(12) United States Patent
Fujita

(10) Patent No.: US 9,568,859 B2
(45) Date of Patent: Feb. 14, 2017

(54) TONER CONVEYING MEMBER FOR REDUCING BENDING OF SAME, DEVELOPING DEVICE, AND IMAGE FORMING APPARATUS

(71) Applicant: Sharp Kabushiki Kaisha, Osaka-shi, Osaka (JP)

(72) Inventor: Syouichi Fujita, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/831,949

(22) Filed: Aug. 21, 2015

(65) Prior Publication Data

US 2016/0054684 A1 Feb. 25, 2016

(30) Foreign Application Priority Data

Aug. 22, 2014 (JP) ..... 2014-169164

(51) Int. Cl.
*G03G 15/08* (2006.01)

(52) U.S. Cl.
CPC .. *G03G 15/0891* (2013.01); *G03G 2215/0827* (2013.01)

(58) Field of Classification Search
CPC ..... G03G 15/0891; G03G 15/0893; G03G 2215/0827; G03G 15/0839
See application file for complete search history.

(56) References Cited

U.S. PATENT DOCUMENTS 4,711,551 A * 12/1987 Fujio ..... G03G 15/0849 399/63
2007/0014954 A1* 1/2007 Yokoi ..... G03G 15/0881 428/36.9
2010/0111572 A1* 5/2010 Hori ..... G03G 15/0822 399/260
2011/0013944 A1 1/2011 Kawaguchi

FOREIGN PATENT DOCUMENTS

JP 2011-022467 A 2/2011
JP 2014-115402 A 6/2014

* cited by examiner

*Primary Examiner* — David Gray
*Assistant Examiner* — Laura Roth
(74) *Attorney, Agent, or Firm* — Keating & Bennett, LLP

(57) ABSTRACT

A toner conveying member is a member with a shaft and a screw around a longitudinal non-end portion (i.e., a central portion) of the shaft integrally molded with resin, and also includes a metal pipe. The metal pipe includes a surrounding portion provided around an end portion of the shaft where the screw is not provided, and a buried portion buried in at least a portion of the screw and extended from the surrounding portion.

6 Claims, 13 Drawing Sheets

TONER CONVEYING MEMBER FOR REDUCING BENDING OF SAME, DEVELOPING DEVICE, AND IMAGE FORMING APPARATUS

BACKGROUND OF THE INVENTION

1. Field of the Invention

The present invention relates to a toner conveying member, a developing device including the toner conveying member, and an image forming apparatus including the developing device.

2. Description of the Related Art

An electrophotographic image forming apparatus is equipped with a developing device in a two-component developing system using a developer containing toner and a carrier or in a one-component developing system using only toner without using a carrier. Such a developing device is provided with a developing roller, and is also provided with a toner conveying member for conveying toner and stirring and mixing toner and a carrier. The toner conveying member is a member with a conveying blade (screw) having a spiral shape or the like arranged on a shaft.

The image forming apparatus is also equipped with a toner supply device for supplying toner from a toner container to the developing device. A toner conveying member may also be used in the toner supply device. Some image forming apparatuses are equipped with cartridges into which a developing roller as a developer carrier, a toner supply device (a toner storage unit, a toner conveying member, a toner supply roller, etc.), and so on are integrated. Of them, a cartridge including a photosensitive drum as an image carrier is also called a process cartridge.

JP 2011-22467 A discloses a developing device (development container) including a toner conveying member. As shown in an axial cross section thereof in FIG. 1, the toner conveying member (mixing and stirring member) 200 has a conveying blade 202 made of resin and a rotating shaft (rotating shaft) 201 made of metal. With this, the developing device prevents the longitudinal deflection of the toner conveying member 200 due to rotation, and continually keeps the distance between the toner conveying member 200 and a detecting surface of a toner concentration detection sensor attached to an inner wall in the development container constant, thereby to stabilize the output of the toner concentration sensor.

JP 2014-115402 A discloses a toner conveying member with a shaft made of resin and a conveying blade made of metal. JP 2014-115402 A also discloses a toner conveying member with a shaft made of metal and a conveying blade made of resin or metal.

However, with the technique described in JP 2011-22467 A, the longitudinal deflection of the toner conveying member due to rotation can be prevented, but the distance between the toner conveying member and the detecting surface of the toner concentration detection sensor is made excessively constant. Therefore, although this technique stabilizes the output of the toner concentration sensor, it causes a problem that a developer conveyed over the detecting surface adheres to the detecting surface such as when the electrical charge of toner increases too much, and thus the correct output of the toner concentration sensor cannot be obtained. Further, with this technique, a metal shaft is present along the entire longitudinal length, which eliminates a problem such as deformation or breakage due to drive stress but causes a problem such as a cost increase.

In the technique described in JP 2014-115402 A, the toner conveying member with the shaft made of resin and the conveying blade made of metal longitudinally bends at the shaft made of resin, causing a developer on a detecting surface to pulsate, and making it hard for the developer to adhere to the top of the detecting surface. Thus, it can solve the above-described problem.

However, a toner conveying member with a shaft made of resin as described in JP 2014-115402 A permanently deforms relatively early at the shaft of the resin material, preventing a developer from being conveyed axially smoothly. Thus, in view of the recovery and recycle of cartridges, it causes a new problem that the number of recyclability of the toner conveying member decreases.

As shown in FIGS. 2A to 2C, it is also considered to put metal pipes (metal collars) 303 on end portions of a shaft 301 (end portions at both ends of a screw 302) of a toner conveying member 300 with the shaft 301 made of resin, to reduce the above new problem. The provision of the metal pipes 303 only at portions corresponding to bearings as illustrated not only reduces the above new problem but also has an advantage of being able to use them also as bearing members. FIG. 2B is an enlarged view showing an axial cross-sectional shape of the toner conveying member in FIG. 2A, and FIG. 2C is a cross-sectional view in the direction C-C in FIG. 2B.

However, when a developer is injected into a development container and a rotation operation is executed, the toner conveying member 300 like this goes into a state where a deflection due to rotational drive occurs, that is, a state where bending occurs. Stress under this state causes a troublesome phenomenon such as rubbing against an inner wall of the development container, the wear of a drive transmission gear, or a deformation at a bearing portion and the vicinity.

SUMMARY OF THE INVENTION

Preferred embodiments of the present invention provide a toner conveying member capable of reducing bending caused by rotational drive, having durability, and reducing a material cost, a developing device including the toner conveying member, and an image forming apparatus including the developing device.

According to a preferred embodiment of the present invention, a toner conveying member includes a shaft; a screw around a longitudinal non-end portion of the shaft, the shaft and the screw being integrally molded with resin; and a metal pipe including a surrounding portion surrounding an end of the shaft where the screw is not located, and a buried portion buried in at least a portion of the screw and extended from the surrounding portion.

The metal pipe may include a plurality of holes in at least the buried portion.

The metal pipe may include no hole in the surrounding portion other than a hole that performs positioning with respect to a mold during molding of the resin.

The metal pipe may continuously extend from the surrounding portion located on one end of the screw to the surrounding portion located on the other end.

According to another preferred embodiment of the present invention, a developing device includes the toner conveying member according to any one of the above-described preferred embodiments of the present invention.

According to another preferred embodiment of the present invention, an image forming apparatus includes the developing device according to the above-described preferred embodiment of the present invention.

Preferred embodiments of the present invention reduce or prevent bending of a toner conveying member caused by rotational drive, achieve increased durability, and significantly reduce material cost.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, toner conveying members, developing devices including the toner conveying members, and image forming apparatuses including the developing devices according to various preferred embodiments of the present invention will be described with examples with reference to the drawings.

First Preferred Embodiment

Figure 3A:
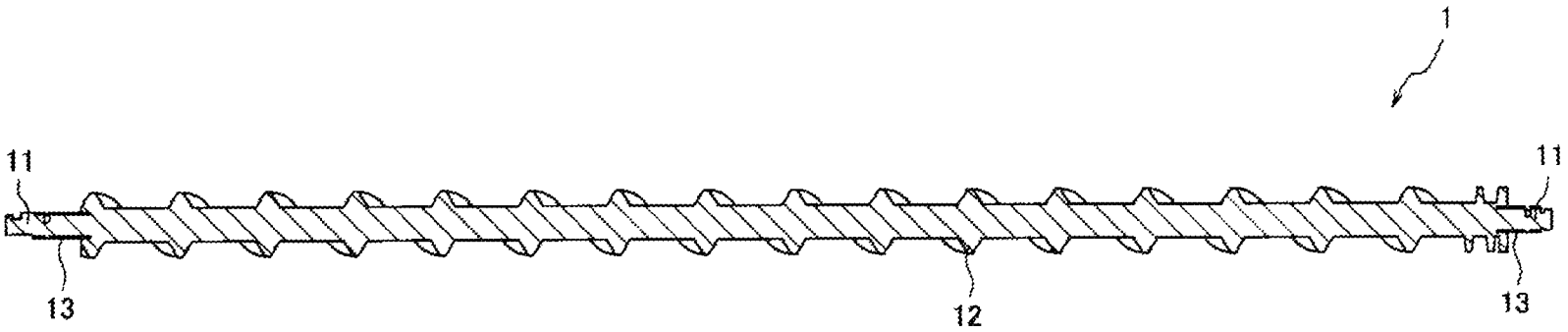
FIG. 3A is a view showing an example of a toner conveying member according to a first preferred embodiment of the present invention.

A first preferred embodiment of the present invention will be described with reference to FIGS. 3A to 5. FIG. 3A is a view showing an example of a toner conveying member according to the first preferred embodiment of the present invention, FIG. 3B is an enlarged view showing an axial cross-sectional shape of the toner conveying member in FIG. 3A, FIG. 3C is a cross-sectional view in the direction C-C in FIG. 3B, FIG. 3D is a cross-sectional view in the direction D-D in FIG. 3B, and FIG. 3E is a cross-sectional view in the direction E-E in FIG. 3B.

A toner conveying member 1 according to this preferred embodiment is a member with a shaft 11 and a screw integrally molded with resin. The shaft 11 has a length that is equal or substantially equal to the length of the toner conveying member 1. For the resin, for example, high impact polystyrene (HIPS), acrylonitrile butadiene styrene copolymer synthetic resin (ABS), polycarbonate (PC), or a mixture of those resins (into which a filler or the like may be mixed) can be used, which is not limiting.

Figure 3B:
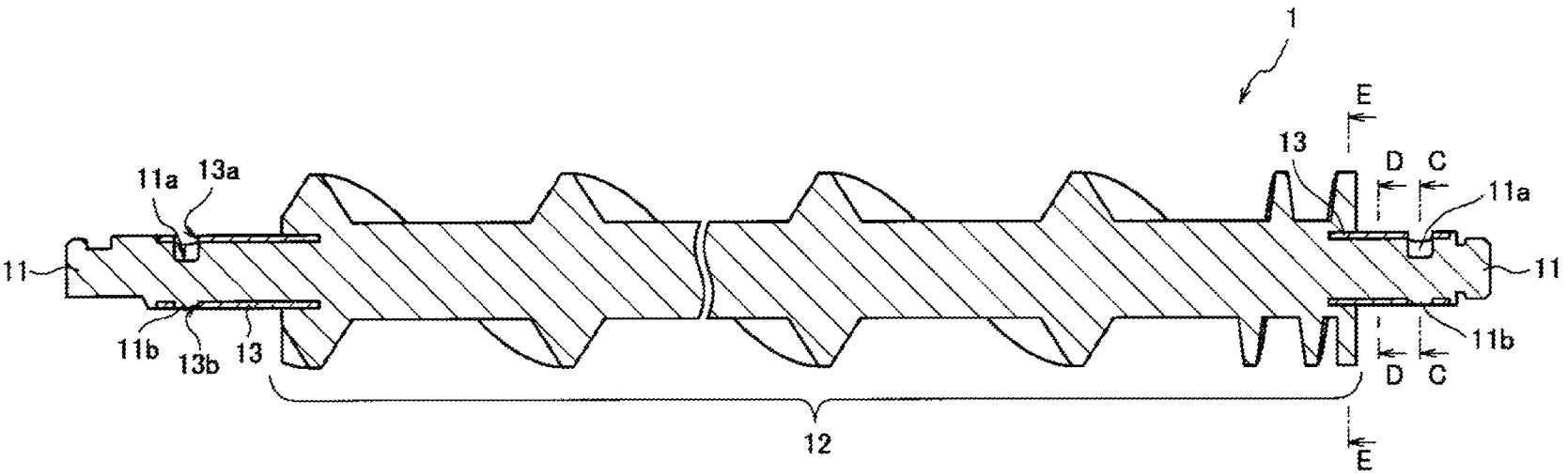
FIG. 3B is an enlarged view showing an axial cross-sectional shape of the toner conveying member in FIG. 3A.
Figure 3C:
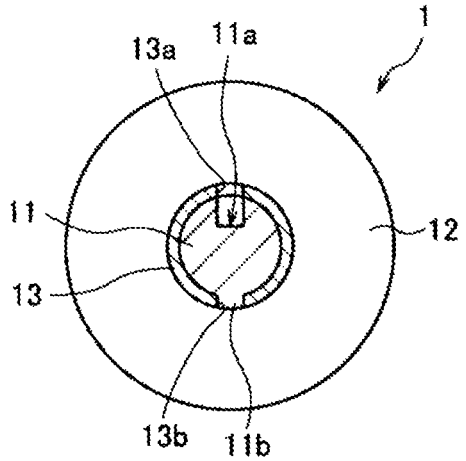
FIG. 3C is a cross-sectional view in the direction C-C in FIG. 3B.
Figure 3D:
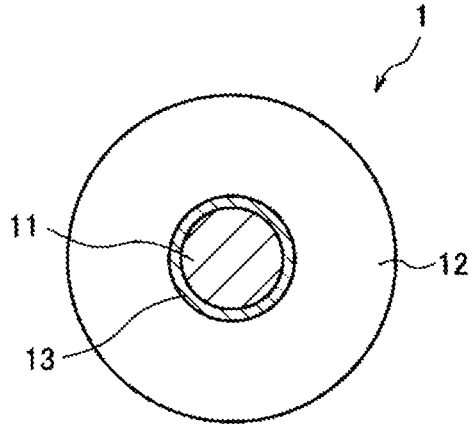
FIG. 3D is a cross-sectional view in the direction D-D in FIG. 3B.
Figure 3E:
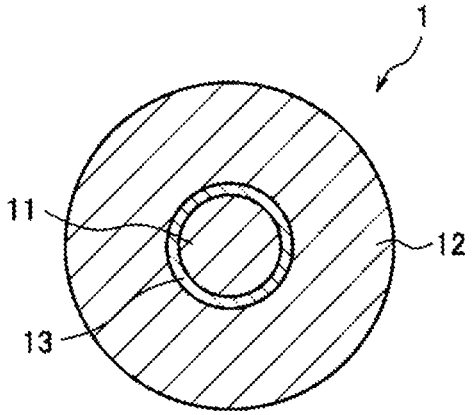
FIG. 3E is a cross-sectional view in the direction E-E in FIG. 3B.

The screw is preferably formed around a longitudinal non-end portion (i.e. a central portion) of the shaft 11, and specifically, is preferably formed around the shaft 11 in a screw forming region 12 as shown in FIGS. 3A and 3B.

FIGS. 3A and 3B show only the cross section of a conveying blade (vane portion) of the screw forming region 12 and do not show its appearance. The appearance may be similar to that of the conveying blade 302 in FIG. 2A, for example. Of course, the shape of the conveying blade may be determined as desired so as to efficiently convey toner, and differs depending on the characteristics of toner used (and a carrier mixed therewith).

When viewed in cross section in a direction perpendicular to the axis, the boundaries between the integrally molded screw and shaft 11 cannot be basically distinguished. However, for example, portions of the screw forming region 12 with a diameter equal to the diameter of end portions of the shaft 11 may be defined as shafts, and the other portion as the screw. Alternatively, only the conveying blade (vane portion) of the screw forming region 12 may be defined as the screw, and portions except the conveying blade may be defined as shafts. Hereinafter, the screw is denoted by the same reference numeral as the screw forming region for convenience (reference numeral "12" in the case of FIGS. 3A to 3E).

The toner conveying member 1 includes metal pipes 13. Metal used for the metal pipes 13 may be, for example, stainless steel (SUS), sulfur composite free-cutting steel material (SUM), or the like, which is not limiting.

The metal pipes 13 include surrounding portions provided around the end portions (non-screws) of the shaft 11 where the screw 12 is not located. Thus, the metal pipes 13 are able to be used as bearing members. However, as illustrated in FIGS. 3A and 3B, the metal pipes 13 do not need to be extended to the endmost portions of the shaft 11, and only need to function as bearing members.

One of the unique features of the present preferred embodiment of the present invention is that the metal pipes 13 include buried portions buried in at least portions of the screw (at least end portions of the screw 12) and extending from the surrounding portions. That is, the shaft 11 is covered by the metal pipes 13 in areas extending from the end portions to the portions of the screw 12, and at the portions, the metal pipes 13 are surrounded with the resin constituting the screw 12.

The metal pipes 13 are preferably integrated with the resin during resin molding. Therefore, as illustrated in FIG. 3B, the metal pipes 13 are preferably provided with holes 13*a* that perform positioning with respect to a mold during molding. Recessed portions 11*a* are preferably provided in the shaft 11 in positions corresponding to the holes 13*a* in conformity with the shape of a positioning protrusion at the mold.

In addition, as illustrated in FIG. 3B, the metal pipes 13 are preferably provided with rotation stopping holes 13*b*, which are filled with resin, so as to prevent the metal pipes 13 from rotating on the resin. By the holes 13*b* and resin 11*b* with which they are filled, the metal pipes 13 are fixed with respect to the shaft 11, which remains unchanged when the shaft 11 rotates.

Alternatively, no holes 13*b* may be provided to allow for slight rotation at the start of rotation or the like. Although the metal pipe 13 on the right side in FIG. 3B is not given reference numerals 13*a* and 13*b*, it is provided with the holes 13*a* and 13*b* as on the left side.

When the metal pipes 13 are not integrated with the resin during resin molding, grooves for insertion of the metal pipes 13 are provided during resin molding in both ends of the screw 12, and the metal pipes 13 are axially fitted afterward on the shaft 11 at the both ends. In that case, the positioning holes 13*a* are not necessary for the metal pipes 13, but rotation stopping holes like the holes 13*b*, protrusions, or the like are preferably provided.

As described above, by integrating the metal pipes 13 to contact bearings, the screw 12, and the shaft 11 of the toner conveying member 1, portions at both end portions of the screw 12 other than portions where the metal pipes 13 and the bearing portions slide are buried in the screw 12 made of resin. Therefore, the toner conveying member 1 not only has a simple configuration but also achieves a significant reduction in bending caused by rotational drive compared with a toner conveying member entirely made of resin or a toner conveying member without a buried portion of a metal pipe, and prevents early permanent deformation by the presence of the metal pipes 13, thus increasing durability. Further, the toner conveying member 1 significantly reduces material cost and weight compared with a toner conveying member using a metal shaft for a shaft.

Alternatively, with a configuration in which, of the metal pipes 13 at the right and left ends in FIGS. 3A and 3B, only one on the side (drive side) directly connected to a drive mechanism to which more stress is applied is buried in the screw 12, and the other on the non-drive side (driven side) is not buried in the screw 12, bending prevention is also obtained.

Figure 4A:
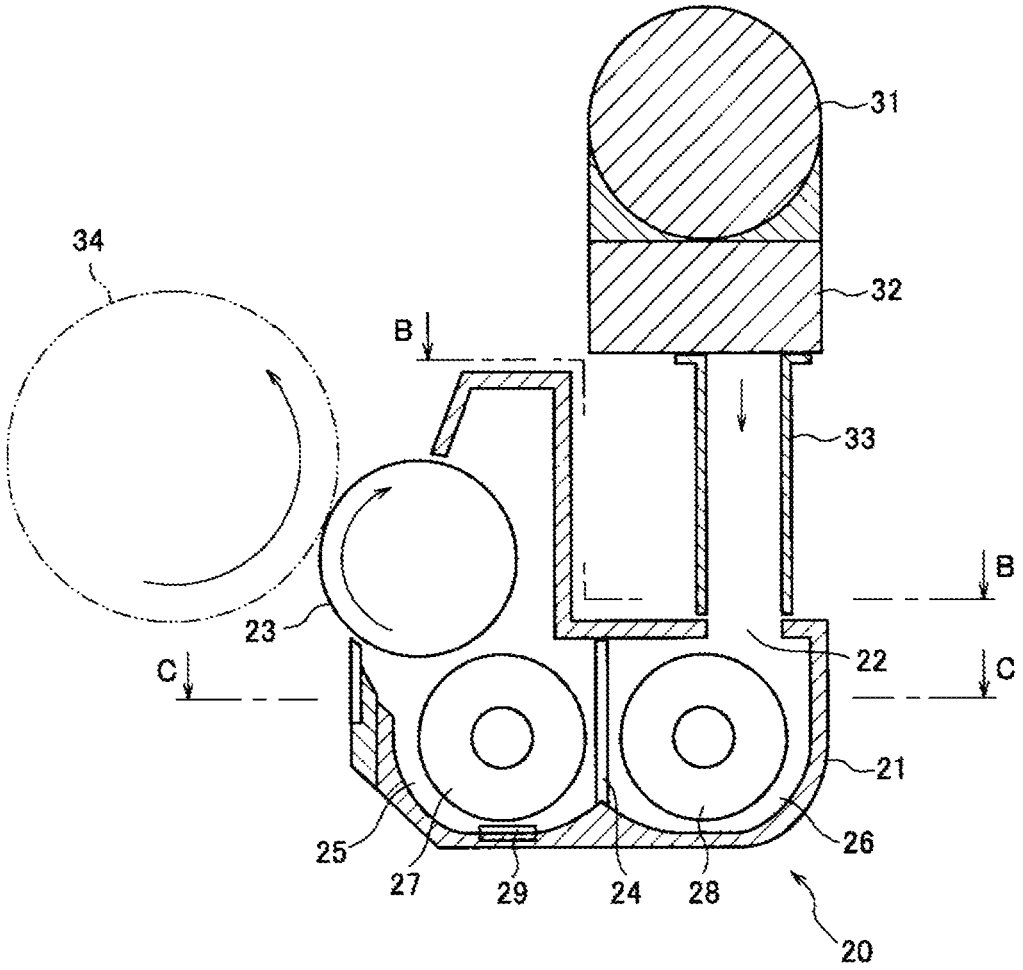
FIG. 4A is a cross-sectional view in a direction perpendicular to an axial direction showing an example of a developing device in which the toner conveying member in FIG. 3A can be mounted.
Figure 4B:
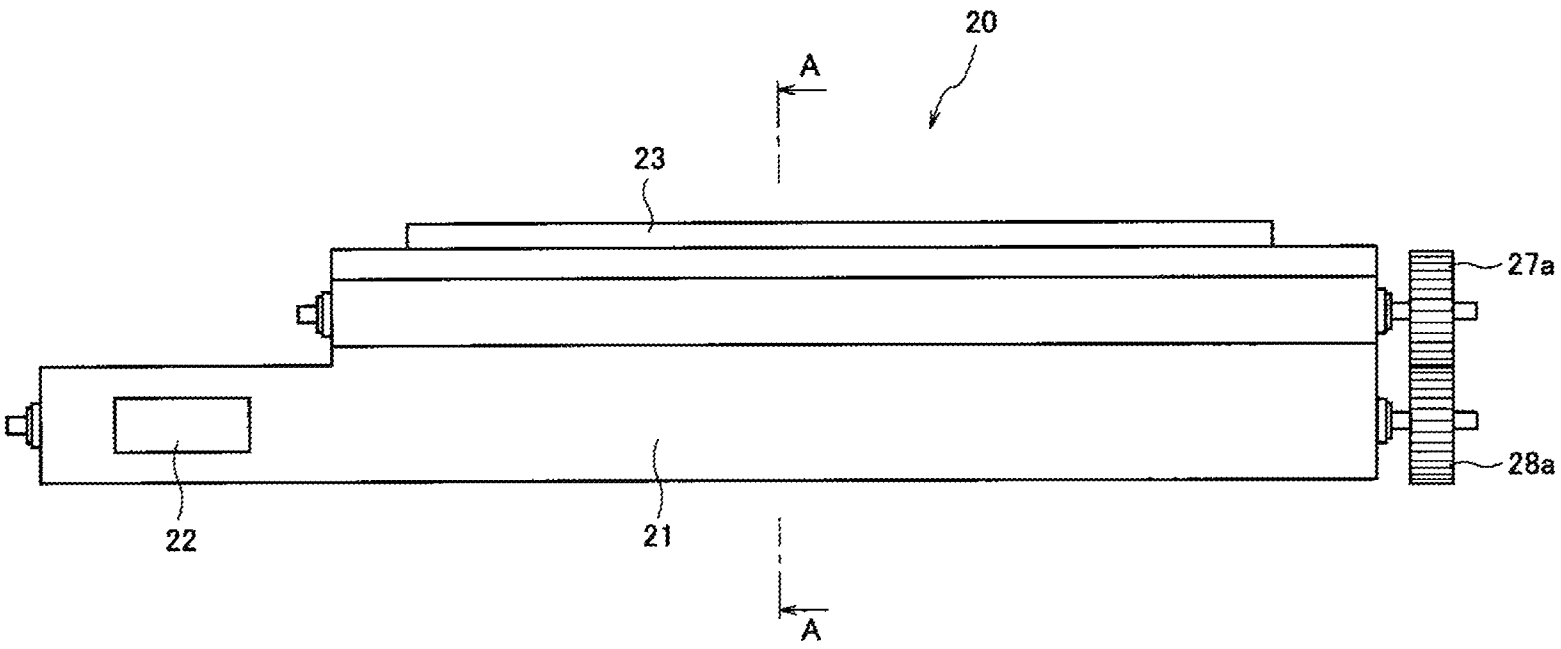
FIG. 4B is a view of the developing device from the direction B-B in FIG. 4A.
Figure 4C:
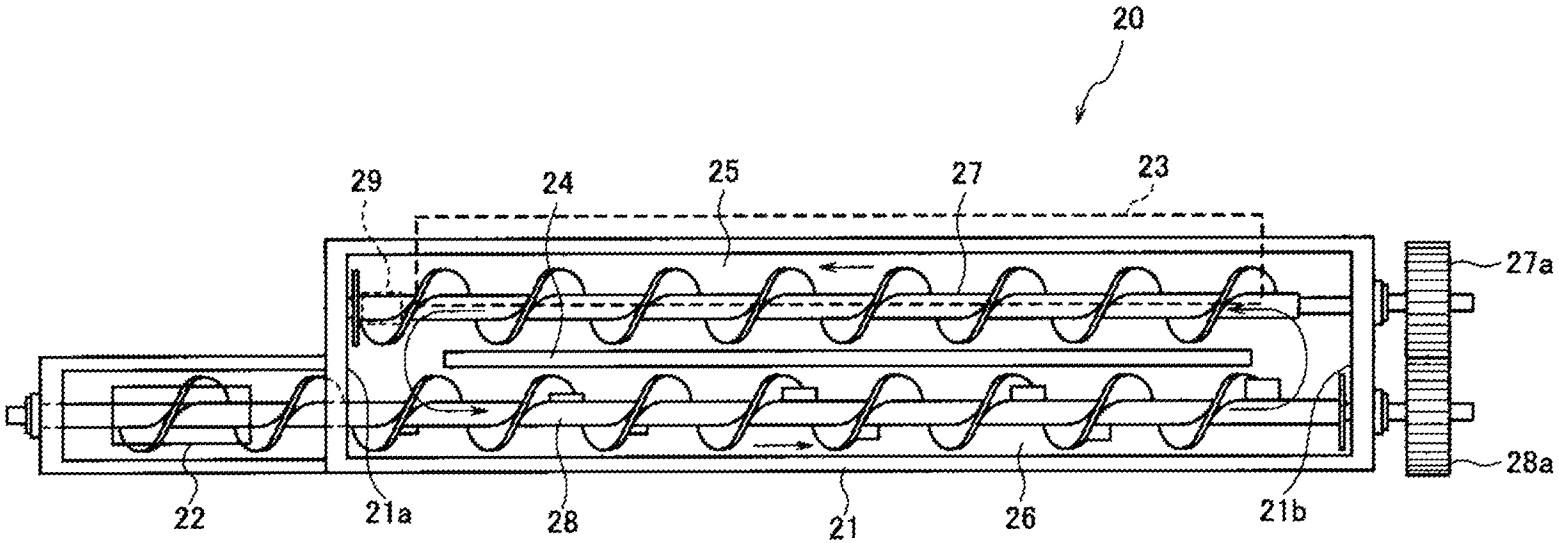
FIG. 4C is a cross-sectional view of the developing device in the direction C-C in FIG. 4A.

Next, an example of a developing device in which the above-described toner conveying member is included will be described with reference to FIGS. 4A to 4C. FIG. 4A is a cross-sectional view in a direction perpendicular to an axial direction showing an example of a developing device in which the toner conveying member in FIG. 3A is be mounted, FIG. 4B is a view of the developing device from the direction B-B in FIG. 4A, and FIG. 4C is a cross-sectional view of the developing device in the direction C-C in FIG. 4A. FIG. 4A corresponds to a cross-sectional view in the A-A direction in FIG. 4B.

A developing device 20 illustrated in FIGS. 4A to 4C causes a two-component developer (not shown) made by stirring and mixing toner and a carrier to be carried on the surface of a developing roller 23 provided in the vicinity of a photosensitive drum 34. The developing device 20 includes a case 21 defining a circulation path of the developer in the vicinity of the developing roller 23 while holding it, a first stirring and conveying screw 27 and a second stirring and conveying screw 28 that conveys the developer along the circulation path.

The developing device 20 also includes a partition plate 24 that partitions the circulation path into a first circulation path 25 on the side where the first stirring and conveying screw 27 is located and a second circulation path 26 on the side where the second stirring and conveying screw 28 is located. The first circulation path 25 and the second circulation path 26 communicate with each other at longitudinal both end portions of the partition plate 24, defining a going out and returning path. The first circulation path 25 is preferably located close to the developing roller 23.

The case 21 includes a toner supply port 22 through which to supply toner from a toner bottle 31 storing the toner. An intermediate hopper 32 is connected to the toner bottle 31, and a toner supply path 33 is connected to the intermediate hopper 32. The toner bottle 31, the intermediate hopper 32, and the toner supply path 33 constitute a toner hopper. The toner hopper is connected to the case 21 so that the toner supply path 33 communicates with the toner supply port 22.

The first and second stirring and conveying screws 27 and 28 are an example of the above-described toner conveying member, and include spiral fins that convey the developer and mixing toner and a carrier as screws on the shafts in a round-rod shape. Metal pipes not shown are also provided to the first and second stirring and conveying screws 27 and 28. The metal pipes have not only surrounding portions in positions corresponding to end portions of the shafts but also buried portions partly buried in the screws as illustrated in FIGS. 3A to 3E.

The first and second stirring and conveying screws 27 and 28 are rotated by drive gears 27*a* and 28*a* provided on their end portions and engaged with each other, respectively. The rotation causes the developer held in the case 21 to be conveyed so as to circulate in directions of arrows through the first circulation path 25 and the second circulation path 26 communicating with each other at the both ends.

The developing device 20 is also provided with a toner concentration sensor 29 in the vicinity of the developing roller 23 located downstream of the circulating system of the developer to be able to measure the toner concentration at the point in time when development has completed. The second stirring and conveying screw 28 is preferably longer than the first stirring and conveying screw 27. A right development container wall 21*b* is only provided with holes enough for the shafts of both to penetrate through, while a left development container wall 21*a* is provided with an opening through which to pass the spiral fin of the second stirring and conveying screw 28. The toner supply port 22 is arranged to the left of and above the opening, so that the toner supplied therefrom does not affect the measurement of the toner concentration sensor 29.

Therefore, a minute change in the toner concentration on the developing roller is able to be detected, and thus by controlling the supply amount (and the stirring speed) of the toner in real time, a target toner concentration is able to be restored. However, the position of the toner concentration sensor 29 is not limited to this, and may be on the second circulation path 26 side or any other position.

Figure 2A:
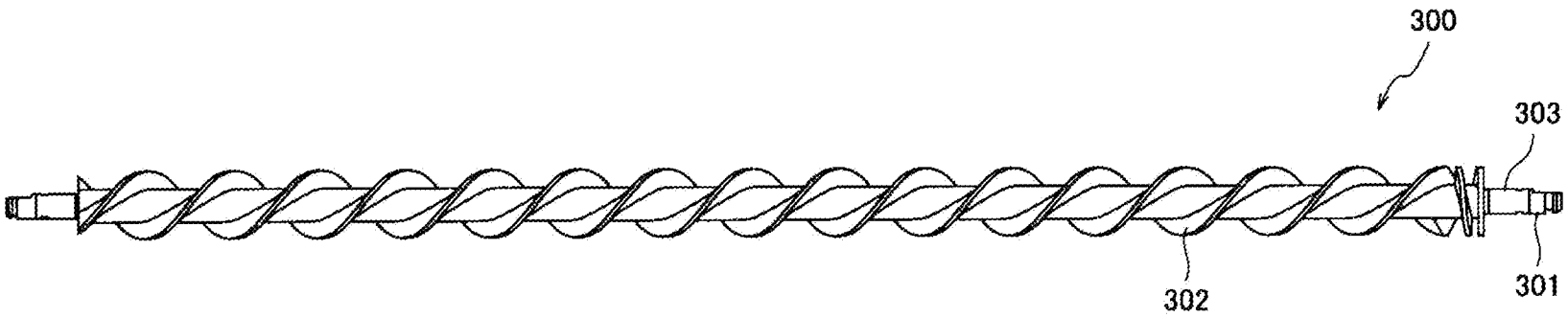
FIG. 2A is a view showing an example of a toner conveying member.
Figure 2B:
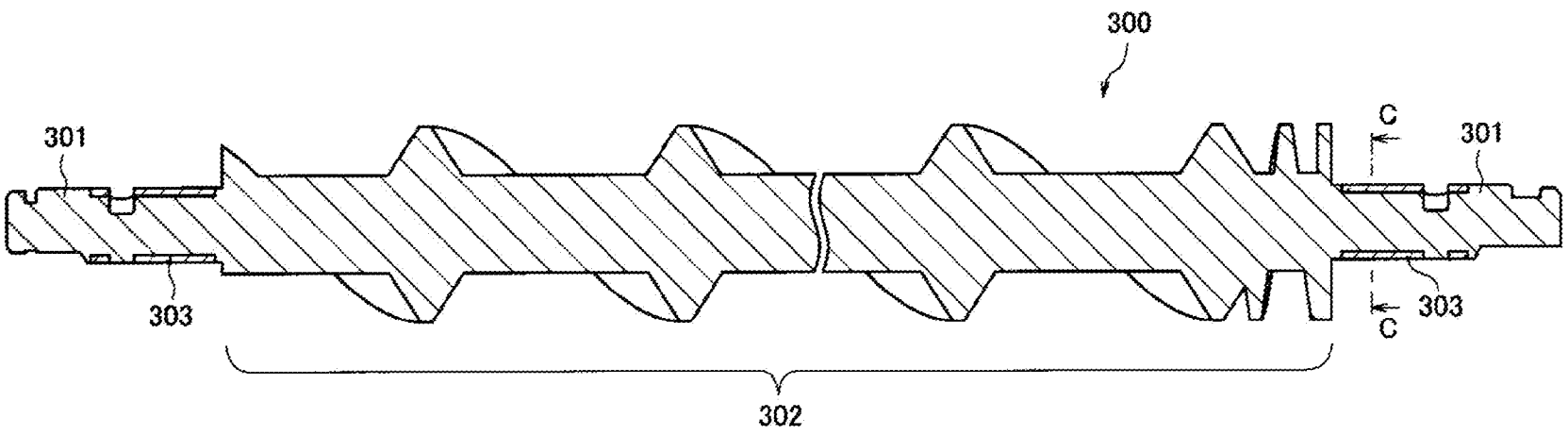
FIG. 2B is an enlarged view showing an axial cross-sectional shape of the toner conveying member in FIG. 2A.
Figure 2C:
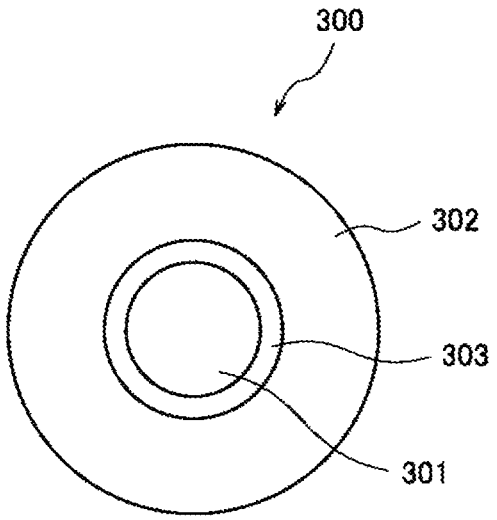
FIG. 2C is a cross-sectional view in the direction C-C in FIG. 2B.

Thus, in a developing device provided with a toner conveying member according to various preferred embodiments of the present invention, bending of the toner conveying member hardly occurs, and detection by a toner detection sensor becomes correct, compared with the case where a toner conveying member without buried portions as shown in FIGS. 2A to 2C is used.

Figure 1:
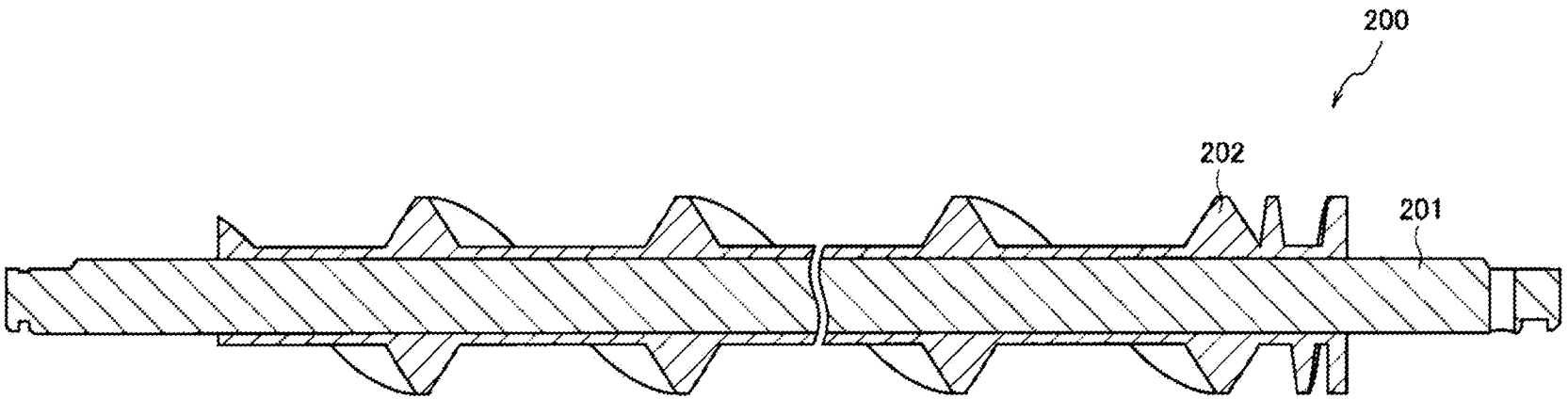
FIG. 1 is an axial cross-sectional view showing a conventional toner conveying member.

Further, when a toner conveying member using a metal shaft as shown in FIG. 1 is used, a portion of the metal shaft is exposed in a development container (in a conveyance path of a developer), and the developer wraps around it, locking the toner conveying member. In the toner conveying member according to various preferred embodiments of the present invention, a portion of a metal pipe that prevents bending is buried in a screw, so that only the screw is able to be arranged in the development container (in the conveyance path of the developer), and therefore the above-described locking does not occur.

Thus, the developing device according to various preferred embodiments of the present invention achieves smooth conveyance of toner, control of toner concentration, and prevention of locking of the toner conveying member. Of course, the configuration of the developing device according to various preferred embodiments of the present invention is not limited to the illustrated ones, and may be a process cartridge having a photosensitive drum as an image carrier or the like, for example. Further, the developing device is not limited to the illustrated two-component developing system, and may be that adopting a one-component developing system.

Further, as described with FIGS. 3A and 3B, portions of metal pipes (buried portions) to be buried in the screw may be provided only on the side where the drive gears 27*a* and 28*a* are present on the first and second stirring and conveying screws 27 and 28. Further, when drive is transmitted from, for example, the side of the drive gear 28*a* of the drive gears 27*a* and 28*a*, provision of buried portions to metal pipes only at both ends of the first stirring and conveying screw 27 as the drive side (or only on the drive gear 27*a* side) also provides a certain bending prevention effect.

In a trickle developing system among developing systems, in which a carrier that is significantly greater in specific gravity than toner is supplied, a shaft of resin material tends to be permanently deformed compared with that in a non-trickle developing system. In that case, a developer is prevented from being axially smoothly conveyed before the output of a toner concentration detection sensor. Therefore, the developing device according to various preferred embodiments of the present invention is particularly advantageous when a trickle developing system, for example, is adopted. When a development container is long, a shaft tends to be permanently deformed compared with the case where it is short. Therefore, the developing device according to various preferred embodiments of the present invention is particularly advantageous also when a preliminary stirring system using a longitudinally long development container is used.

Figure 5:
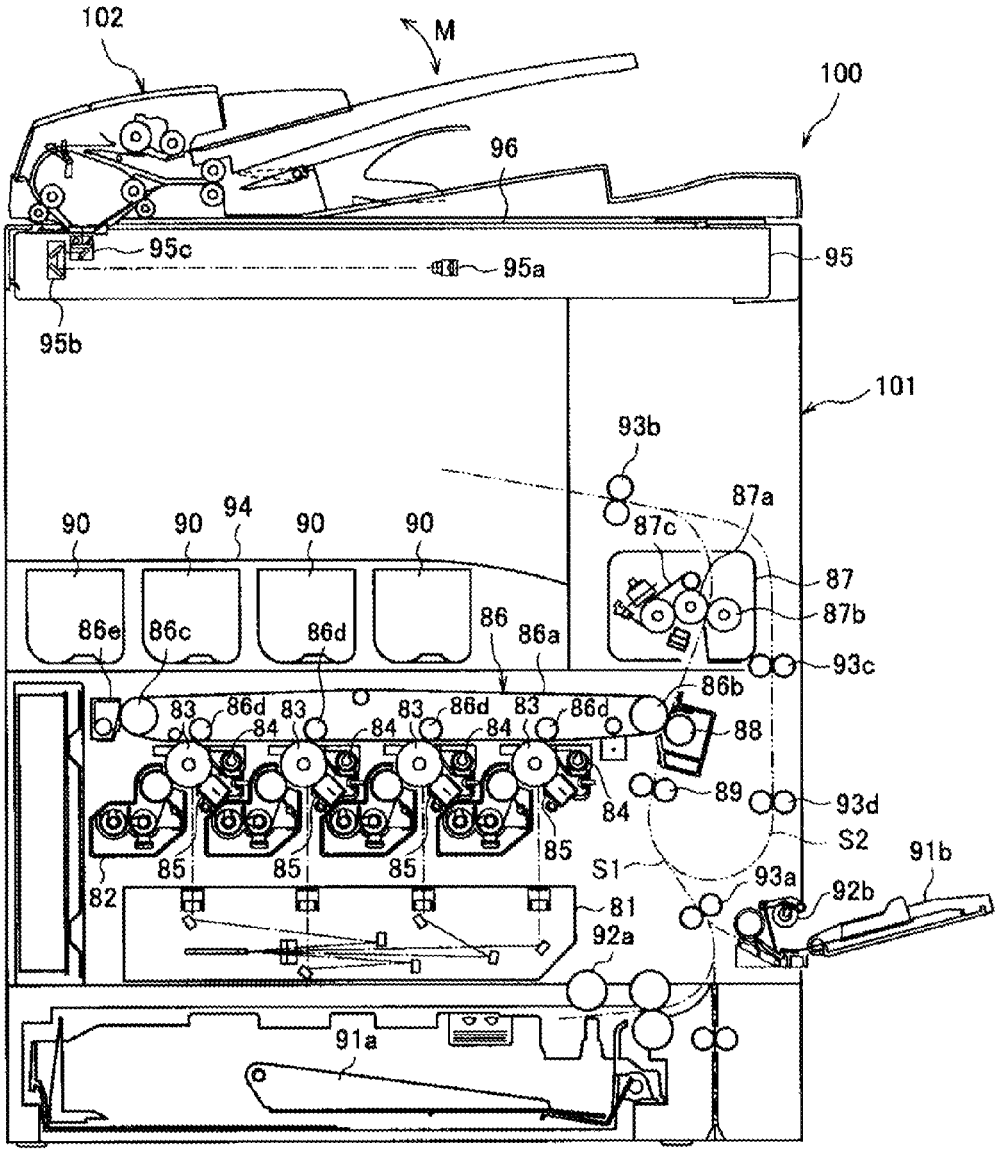
FIG. 5 is a cross-sectional view showing an example of an image forming apparatus in which the developing device in FIG. 4A can be mounted.

Hereinafter, an example of an image forming apparatus in which a developing device as described above is able to be provided will be described with reference to FIG. 5. FIG. 5 is a cross-sectional view showing an example of an image forming apparatus in which the developing device in FIG. 4A can be mounted. FIG. 5 shows a configuration example of a multifunction machine as an example of the image forming apparatus.

An image forming apparatus 100 forms an image on recording paper in an electrophotographic system, based on image data transmitted from outside or read by a scanner (image reading device), and includes an apparatus body 101 and an automatic original handling device 102.

The apparatus body 101 includes an exposure unit 81, developing units 82, photosensitive drums 83, cleaner units 84, charging units 85, an intermediate transfer belt unit 86, a fusing unit 87, a paper feed cassette 91*a*, a paper output tray 94, and so on. Here, the developing units 82 correspond to an example of the developing device according to various preferred embodiments of the present invention.

An original setting table 96 made of transparent glass is provided at the top of the apparatus body 101. Above that, the automatic original handling device 102 that automatically conveys an original to the original setting table 96 is mounted. The automatic original handling device 102 is rotatable in the directions of arrows M. By opening the top of the original setting table 96, an original is able to be placed by manual placement.

The apparatus body 101 includes an image reading device 95 housed in a casing. The image reading device 95 is an image reading device in a reduction optical system including a light source unit 95*a* holding a light source and a first mirror, a mirror unit 95*b* holding second and third mirrors, and a lens and a CCD 95*c*. The apparatus body 101 is also provided with an operating panel not shown to allow for operation input by a user. The apparatus body 101 also includes an input interface that inputs image data from an externally connected apparatus, or a reader that reads image data from a portable recording medium (neither of them shown).

Image data handled by the image forming apparatus 100 preferably corresponds to a color image in four colors, black (K), cyan (C), magenta (M), and yellow (Y), for example. Therefore, the four development units 82, photosensitive drums (image carriers) 83, cleaner units 84, and charging units 85 are provided to define four types of latent image for the respective colors. These constitute four image stations. The developing units 82 for the respective colors are connected to toner bottles 90 for the respective colors via paths not shown to be supplied with toner of the respective colors.

The exposure unit 81 preferably is a laser scanning unit (LSU) including a laser emitting portion, reflection mirrors, and so on. In the exposure unit 81, optical components such as a polygon mirror that scans a laser beam, lenses and mirrors to guide laser light reflected by the polygon mirror to the photosensitive drums 83, and so on are disposed. Alternatively, as the exposure unit 81, a method of using a writing head with light-emitting elements arranged in an array may be adopted.

The exposure unit 81 exposes the charged photosensitive drums 83 according to input image data, thus forming electrostatic latent images on their surfaces according to the image data. The developing units 82 render the electrostatic latent images formed on the respective photosensitive drums 83 visible by the toner of the four colors (Y, M, C, K). The cleaner units 84 remove and collect toner remaining on the surfaces of the photosensitive drums 83 after development and image transfer. The charging units 85 charge the surfaces of the photosensitive drums 83 uniformly at a predetermined potential, for which a charging unit in a charger type as shown in FIG. 5, or in a roller type or brush type as a contact type may be used.

The intermediate transfer belt unit 86 disposed above the photosensitive drums 83 includes an intermediate transfer belt 86*a*, an intermediate transfer belt drive roller 86*b*, an intermediate transfer belt driven roller 86*c*, intermediate transfer rollers 86*d*, and an intermediate transfer belt cleaning unit 86*e*. The four intermediate transfer rollers 86*d* are provided for the respective colors of Y, M, C, and K. The intermediate transfer belt drive roller 86*b*, the intermediate transfer belt driven roller 86*c*, and the intermediate transfer rollers 86*d* rotationally drive the intermediate transfer belt 86*a* while stretching it. Each intermediate transfer roller 86*d* provides a transfer bias that transfers a toner image on the photosensitive drum 83 onto the intermediate transfer belt 86*a*.

The intermediate transfer belt 86*a* is provided to contact the photosensitive drums 83. By transferring toner images in the respective colors formed on the photosensitive drums 83 to the intermediate transfer belt 86*a* sequentially in layers, a toner image (multicolor toner image) in color is formed on the intermediate transfer belt 86*a*. The intermediate transfer belt 86*a* preferably has an endless shape using a film with a thickness of about 100 μm to about 150 μm, for example.

The transfer of toner images from the photosensitive drums 83 to the intermediate transfer belt 86*a* is performed by the intermediate transfer rollers 86*d* contacting the undersurface of the intermediate transfer belt 86*a*. To the intermediate transfer rollers 86*d*, a high-voltage transfer bias (a high voltage with a polarity (+) opposite to the charging polarity (−) of the toner) is applied to transfer toner images. The intermediate transfer rollers 86*d* are rollers with metal (e.g. stainless steel) shafts having a diameter of about 8 mm to about 10 mm as a base, covered by a conductive elastic material (such as EPDM or urethane foam, for example) at their surfaces. The conductive elastic material achieves a uniform application of a high voltage to the intermediate transfer belt 86*a*. Although a roller shape is used as a transfer electrode in this configuration example, a brush or the like may alternatively be used.

Electrostatic images rendered visible according to color phases on the photosensitive drums 83 as described above are layered on the intermediate transfer belt 86*a*. The layered electrostatic images are transferred to recording paper by the rotation of the intermediate transfer belt 86*a* and by a transfer roller 88 described below as a secondary transfer mechanism disposed in a position of contact between paper and the intermediate transfer belt 86*a*. The secondary transfer mechanism is not limited to the transfer roller, and a corona charger or a transfer belt may be used.

At this time, the intermediate transfer belt 86*a* is pressed against the transfer roller 88 with a predetermined nip, and a voltage (a high voltage with a polarity (+) opposite to the charging polarity (−) of the toner) that transfers the toner to paper is applied to the transfer roller 88. Further, in order for the transfer roller 88 to provide the nip steadily, one of the transfer roller 88 and the intermediate transfer belt drive roller 86*b* is made of a hard material (such as metal) and the other is made of a soft material such as an elastic roller (such as an elastic rubber roller or a resin foam roller).

As described above, it is configured that toner adhering to the intermediate transfer belt 86*a* by contact with the photosensitive drums 83, or toner remaining on the intermediate transfer belt 86*a* without being transferred to recording paper by the transfer roller 88 is removed and collected by the intermediate transfer belt cleaning unit 86*e* because it may cause occurrence of color mixing of toner in the next step. The intermediate transfer belt cleaning unit 86*e* is provided with a cleaning blade as a cleaning member, for example, which contacts the intermediate transfer belt 86*a*. The intermediate transfer belt 86*a* in contact with the cleaning blade is supported by the intermediate transfer belt driven roller 86*c* from the undersurface.

The paper feed cassette 91*a* is a tray that stores recording paper (sheets) to be used for image formation, and is provided below the exposure unit 81 of the apparatus body 101. Recording paper to be used for image formation may also be placed on a manual paper feed cassette 91*b*. The paper output tray 94 provided on the upper side of the apparatus body 101 is a tray to collect printed recording paper face down.

The apparatus body 101 is provide with a sheet conveyance path S1 in a generally vertical form to send recording paper on the paper feed cassette 91*a* and the manual paper feed cassette 91*b* through the transfer roller 88 and the fusing unit 87 to the paper output tray 94. In the vicinity of the sheet conveyance path S1 from the paper feed cassette 91*a* or the manual paper feed cassette 91*b* to the paper output tray 94, pickup rollers 92*a* and 92*b*, a plurality of conveyance rollers 93*a* to 93*d*, resist rollers 89, the transfer roller 88, the fusing unit 87, and so on are arranged.

The conveyance rollers 93*a* to 93*d* are small rollers that accelerate and assist the conveyance of recording paper, and are provided along the sheet conveyance path S1. The pickup roller 92*a* is provided in the vicinity of an end portion of the paper feed cassette 91*a*, and picks up recording paper one by one from the paper feed cassette 91*a* to feed it to the sheet conveyance path S1. Likewise, the pickup roller 92*b* is provided in the vicinity of an end portion of the manual paper feed cassette 91*b*, and picks up recording paper one by one from the manual paper feed cassette 91*b* to feed it to the sheet conveyance path S1.

The resist rollers 89 temporarily hold recording paper conveyed along the sheet conveyance path S1. The resist rollers 89 convey recording paper to the transfer roller 88 at a timing to align the front end of the recording paper with the front end of a toner image on the intermediate transfer belt 86*a*.

The fusing unit 87 includes a heat roller 87*a* and a pressure roller 87*b*. The heat roller 87*a* and the pressure roller 87*b* rotate, holding recording paper between them. The heat roller 87*a* is set to be at a predetermined fusing temperature by a controller based on a signal from a temperature detector not shown, and thermocompression bonds toner to recording paper with the pressure roller 87*b*, thus melting, mixing, and press-contacting a multicolor toner image transferred to recording paper for heat fusing to the recording paper. An external heating belt 87*c* that heats the heat roller 87*a* from outside is also provided.

Next, the conveyance path of recording paper will be described in more detail. As described above, the image forming apparatus 100 is provided with the paper feed cassette 91*a* that hold recording paper in advance, and the manual paper feed cassette 91*b*. In order to feed recording paper from these paper feed cassettes 91*a* and 91*b*, the pickup rollers 92*a* and 92*b* are disposed to guide recording paper one by one to the sheet conveyance path S1.

Recording paper conveyed from the paper feed cassette 91*a* or 91*b* is conveyed to the resist rollers 89 by the conveyance rollers 93*a* on the sheet conveyance path S1, and conveyed to the transfer roller 88 at a timing to align the front end of the recording paper with the front end of image information on the intermediate transfer belt 86*a*, and the image information is written on the recording paper. Thereafter, the recording paper passes through the fusing unit 87 so that unfused toner on the recording paper is melt and fixed by heat, and passes through the conveyance rollers 93*b* arranged behind that and is discharged on the paper output tray 94.

The above-described conveyance path is one when single-side printing on recording paper is requested. On the other hand, when double-side printing is requested, when the rear end of recording paper having passed through the fusing unit 87 after completion of single-side printing is held by the final conveyance rollers 93*b* as described above, the conveyance rollers 93*b* rotate backward, thus guiding the recording paper to a conveyance path S2 on which conveyance rollers 93*c* and 93*d* are disposed. Then, the conveyance path S2 merges with the conveyance path S1, and the recording paper is conveyed from the resist rollers 89 to the transfer roller 88. At this time, the back side of the recording paper is printed at the transfer roller 88 since the recording paper is turned upside down at a stage where it merges from the conveyance path S2 with S1. The recording paper with the back side printed is fused by the fusing unit 87 and discharged to the paper output tray 94.

Although the developing device and the image forming apparatus have been described with examples, a developing device and an image forming apparatus in which the toner conveying member in the preferred embodiments is able to be mounted are not limited to them. For example, an image forming apparatus is provided with a toner supply device that supplies toner from a toner container (the toner bottle 31 in FIG. 4A, the toner bottles 90 in FIG. 5) to a developing device, and a toner conveying member with a metal pipe having a portion buried in a screw as in various preferred embodiments of the present invention may be used in the toner supply device.

Second Preferred Embodiment

A toner conveying member according to a second preferred embodiment of the present invention will be described with reference to FIGS. 6A and 6B. In this preferred embodiment, various application examples according to the first preferred embodiment can also be applied. The toner conveying member according to this preferred embodiment can be mounted in a developing device and in an image forming apparatus as described in the first preferred embodiment.

Figure 6A:
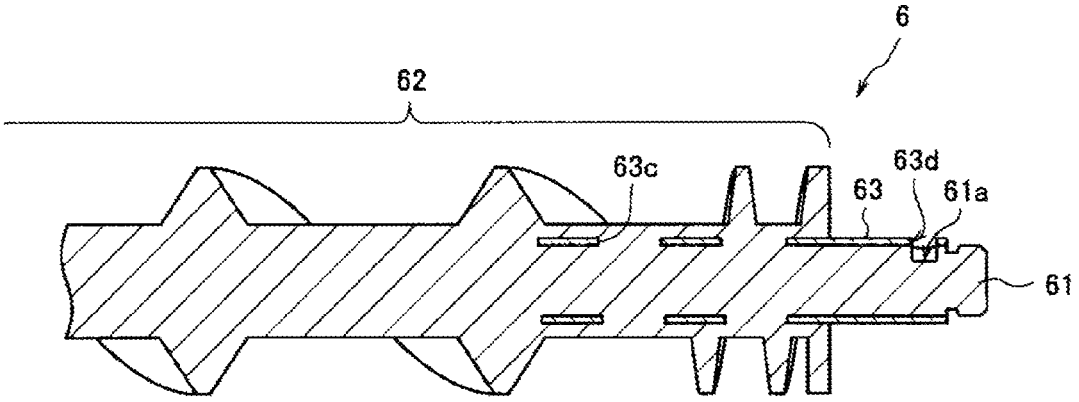
FIG. 6A is an enlarged view showing an axial cross-sectional shape of an example of a toner conveying member according to a second preferred embodiment of the present invention.

FIG. 6A is an enlarged view showing an axial cross-sectional shape of an example of a toner conveying member according to the second preferred embodiment of the present invention. FIG. 6B is a view showing an example of a metal pipe provided to the toner conveying member in FIG. 6A.

Figure 6B:
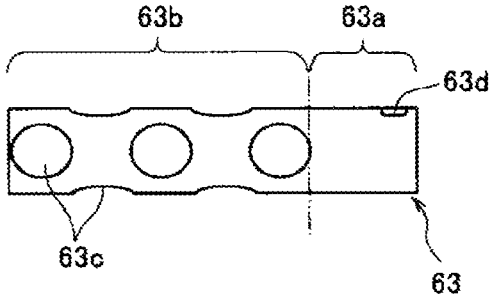
FIG. 6B is a view showing an example of a metal pipe provided to the toner conveying member in FIG. 6A.

As illustrated in FIGS. 6A and 6B, a toner conveying member 6 according to this preferred embodiment includes a metal pipe 63 in place of the metal pipe 13 of the toner conveying member 1. The metal pipe 63 includes a buried portion 63*b* buried in a screw 62. A plurality of holes 63*c* is provided at least in the buried portion 63*b*. The arrangement of the holes 63*c* is not limited to that illustrated, and the shape thereof is not limited to a circle.

Thus, the metal pipe 63 includes the holes 63*c* in the buried portion 63*b*, which stops rotation, and eliminates the need to provide a hole used to stop rotation corresponding to the hole 13*b* in the metal pipe 13.

It is preferable that in the metal pipe 63 a surrounding portion 63*a* in a position corresponding to the above-described end portion of a shaft 61 should not be provided with any hole other than a hole 63*d* used to position with respect to a mold during resin molding. This provides better sliding on bearings. The hole 63*d* corresponds to the hole 13*a* in the metal pipe 13, and a recessed portion 61*a* corresponds to the recessed portion 11*a* in the shaft 11. Alternatively, in place of the positioning hole 63*d*, a configuration in which an end of the metal pipe 63 is partly cut may be used.

Third Preferred Embodiment

A toner conveying member according to a third preferred embodiment of the present invention will be described with reference to FIGS. 7A to 7C. In this preferred embodiment, various application examples according to the first and second preferred embodiments can also be applied. The toner conveying member according to this preferred embodiment is able to be mounted in a developing device and in an image forming apparatus as described in the first preferred embodiment.

Figure 7A:
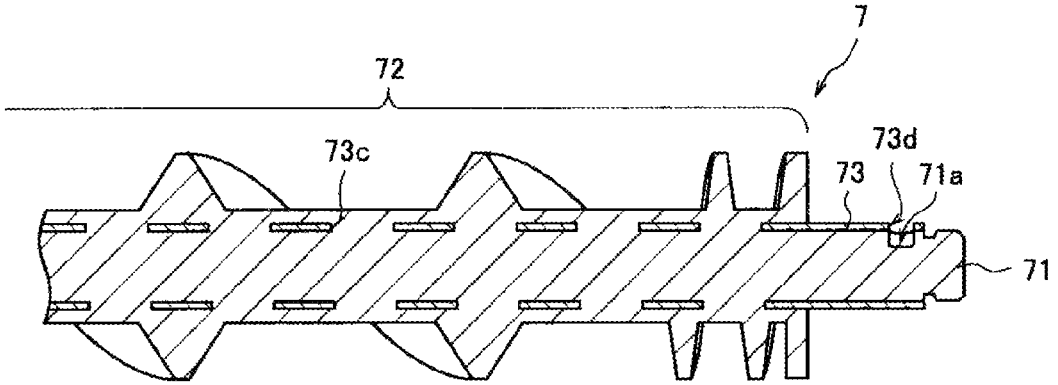
FIG. 7A is an enlarged view showing an axial cross-sectional shape of an example of a toner conveying member according to a third preferred embodiment of the present invention.

FIG. 7A is an enlarged view showing an axial cross-sectional shape of an example of a toner conveying member according to the third preferred embodiment of the present invention. FIG. 7B is a view showing a portion of an example of a metal pipe provided to the toner conveying member in FIG. 7A, and FIG. 7C is a view showing the entirety of the example of the metal pipe provided to the toner conveying member in FIG. 7A.

Figure 7B:
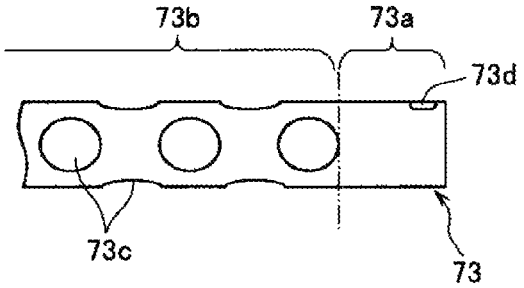
FIG. 7B is a view showing a portion of an example of a metal pipe provided to the toner conveying member in FIG. 7A.
Figure 7C:
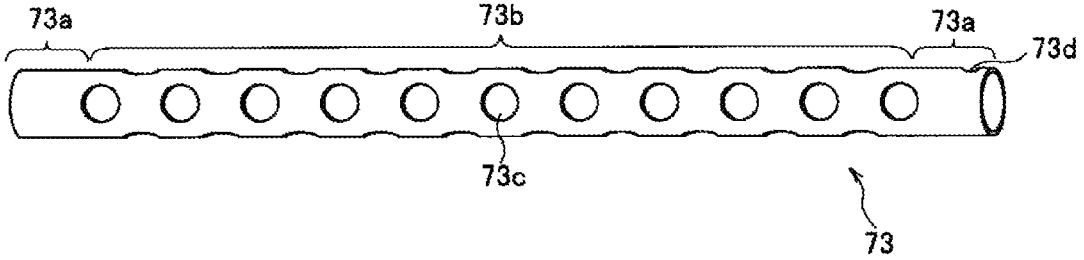
FIG. 7C is a view showing the entirety of the example of the metal pipe provided to the toner conveying member in FIG. 7A.

As illustrated in FIGS. 7A to 7C, a toner conveying member 7 according to this preferred embodiment includes a single metal pipe 73 in place of the metal pipe 63 of the toner conveying member 6. The metal pipe 73 has holes 73*c* in a buried portion 73*b* like the metal pipe 63, which stop rotation, and thus eliminates the need to provide a hole that stops rotation corresponding to the hole 13*b* in the metal pipe 13. Therefore, also in this example, the metal pipe 73 has no holes in surrounding portions 73*a* other than the positioning hole. A hole 73*d* corresponds to the hole 63*d* in the metal pipe 63, and a recessed portion 71*a* corresponds to the recessed portion 61*a* in the shaft 61.

One of the unique features of this preferred embodiment is that the single metal pipe 73 is provided and, as illustrated in FIG. 7C in its entirety, continuously extends from the surrounding portion 73*a* located on one end side of a screw 72 (via the buried portion 73*b*) to the surrounding portion 73*a* located on the other end side. That is, the metal pipe 73 in this preferred embodiment includes the surrounding portions 73*a* continuous with both ends of the buried portion 73*b*.

In this preferred embodiment, the configuration like this allows for a more reduction in bending and a more improvement in durability compared with the first and second preferred embodiments. Further, although the single metal pipe is used for the toner conveying member 7 in this preferred embodiment, the metal pipe 73 is provided with the holes 73*c*, and thus a shaft 71 and the screw 72 can be integrally molded.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A toner conveying member comprising:

a shaft;

a screw around a longitudinal non-end portion of the shaft, the shaft and the screw being integrally molded of resin; and a metal pipe including a surrounding portion around an end portion of the shaft where the screw is not provided, and a buried portion buried in at least a portion of the screw and extended from the surrounding portion.

2. The toner conveying member according to claim 1, wherein the metal pipe includes a plurality of holes in at least the buried portion.

3. The toner conveying member according to claim 2, wherein the metal pipe has no hole in the surrounding portion other than a hole that positions with respect to a mold during molding of the resin.

4. The toner conveying member according to claim 2, wherein the metal pipe continuously extends from the surrounding portion located on one end of the screw to the surrounding portion located on the other end.

5. A developing device comprising the toner conveying member according to claim 1.

6. An image forming apparatus comprising the developing device according to claim 5.

* * * * *